US006398528B1

(12) United States Patent
Hansen et al.

(10) Patent No.: US 6,398,528 B1
(45) Date of Patent: Jun. 4, 2002

(54) DUAL LOBE, SPLIT RING, VARIABLE ROLLER VANE PUMP

(75) Inventors: Lowell D. Hansen, Sagamore Hills; E. Kent Miller, Kirtland; Sam Maxwell, Twinsburg, all of OH (US)

(73) Assignee: Argo-Tech Corporation, Cleveland, OH (US)

( * ) Notice: Subject to any disclaimer, the term of this patent is extended or adjusted under 35 U.S.C. 154(b) by 0 days.

(21) Appl. No.: 09/638,684

(22) Filed: Aug. 14, 2000

Related U.S. Application Data

(60) Provisional application No. 60/148,828, filed on Aug. 13, 1999.

(51) Int. Cl.[7] ..... F04C 2/344; F04C 15/04

(52) U.S. Cl. ..... 418/25; 418/27; 418/31; 418/225

(58) Field of Search ..... 418/24–27, 31, 418/225

(56) References Cited

U.S. PATENT DOCUMENTS

| | | | | |
|---|---|---|---|---|
| 1,670,229 A | | 6/1928 | Balsiger | 418/31 |
| 2,097,718 A | * | 11/1937 | Bilderbeck | 418/225 |
| 2,141,170 A | * | 12/1938 | Centervall | 418/31 |
| 2,631,544 A | | 3/1953 | Wilcox | 418/24 |
| 3,015,212 A | * | 1/1962 | Krafft et al. | 418/26 |
| 3,112,709 A | | 12/1963 | Yarmak | 418/26 |
| 3,134,334 A | * | 5/1964 | Smith | 418/31 |
| 3,560,118 A | | 2/1971 | Palachik | 418/31 |
| 3,604,823 A | | 9/1971 | Thomas | 418/26 |
| 3,663,130 A | | 5/1972 | Lincks | 418/31 |
| 3,672,796 A | | 6/1972 | Mitchell | 418/26 |
| 3,784,326 A | | 1/1974 | Lagana et al. | 418/31 |
| 4,406,599 A | | 9/1983 | Stephan | 418/22 |
| 4,439,117 A | | 3/1984 | Bunger | 418/22 |
| 4,445,830 A | | 5/1984 | Woodruff | 418/22 |
| 5,316,450 A | | 5/1994 | Kast | 417/295 |
| 5,378,112 A | | 1/1995 | Nasvytis | 417/213 |
| 5,545,014 A | | 8/1996 | Sundberg et al. | 417/204 |
| 6,022,201 A | * | 2/2000 | Kasmer | 418/31 |

FOREIGN PATENT DOCUMENTS

| | | | | |
|---|---|---|---|---|
| DE | 2 004 300 | | 11/1970 | |
| DE | 30 01 673 A1 | | 1/1980 | |
| JP | 46-23691 | * | 7/1971 | 418/26 |
| WO | WO 97/43518 | | 11/1997 | |

* cited by examiner

*Primary Examiner*—John J. Vrablik
(74) *Attorney, Agent, or Firm*—Fay, Sharpe, Fagan, Minnich & McKee, LLP

(57) ABSTRACT

A dual lobe, split ring, variable displacement roller vane pump is provided for supplying an aircraft engine varying amount of fuel. In a preferred application, the pump is used with a gas turbine engine. The pump includes a housing having an inlet and an outlet, a rotor rotatably mounted within the housing and having a plurality of slots, and a plurality of roller vanes operatively mounted within the slots. The pump further includes a pair of port plates mounted on either side of the rotor and two cam segments received around the rotor. The cam segments each have a curvilinear surface for cooperating with the rotor, the port plates, and the roller vanes to define a plurality of pumping chambers. The cam segments are independently movable to create varying volumetric pumping chambers along the curvilinear surface of the cam segments.

19 Claims, 9 Drawing Sheets

DUAL LOBE, SPLIT RING, VARIABLE ROLLER VANE PUMP

This application claims the benefit of and hereby expressly incorporates by reference U.S. Provisional Application Serial No. 60/148,828, filed on Aug. 13, 1999.

BACKGROUND OF THE INVENTION

1. Field of the Invention

The present invention relates to variable displacement vane pumps and, more particularly, to an improved dual lobe, split ring, variable displacement roller vane pump. It finds a particular application as a pump for delivering fuel to an aircraft jet engine or gas turbine and will be described with particular reference thereto. However, it will be appreciated that the present invention is also amenable to other applications that can advantageously use the features of the variable output flow of the pump.

2. Discussion of the Art

Turbine engines on aircraft require variable amounts of fuel during operation. For example, the fuel flow needs of a turbine engine during takeoff are significantly different than during high altitude cruising and not proportional to the speed of the engine. To accommodate these changing needs, in the present state of the art, fuel is pumped to the engine using a fixed positive displacement pump in conjunction with a variable delivery fuel system.

Variable delivery has been achieved in a number of different manners including changing the geometry of the positive displacement pump and/or bypassing a portion of the excess pumped fuel back to the pump inlet. Generally, bypass systems have been favored in the industry. In such a system, the delivery of variable fuel flow to the engine is achieved by selectively bypassing excess flow to an interstage or inlet of the positive displacement pump.

Conventional positive displacement pumps include gear pumps, vane pumps, or piston pumps. When the variable delivery system is a bypass system, the pumps are typically fixed displacement pumps that deliver a preset amount of fuel at a given speed. Such systems employing a fixed displacement pump and a bypass are heavy, inefficient and sometimes temperamental.

Variable displacement pumps, in contrast, have not been favored for the delivery of fuel to aircraft engines (pumps operating in the order of 8,000 rpm and 1500 psid). Although more efficient as a component, fixed displacement pumps have, heretofore, caused undesirable heating of the fuel in a fuel delivery system. Fuel system heating needs to be minimized in many advanced engine systems such as those used in aircraft applications.

Variable, positive displacement pumps operate by first capturing a controlled variable volume of fluid from the pump inlet, then pushing the captured fluid into a discharge line. Typically, variable displacement vane pumps are somewhat intolerant to contamination. Other shortcomings include vane tipping and excessive vane tip loading at inlet and discharge port openings, significant pressure pulsations and cavitation caused by fluid trapping in the seal arcs, high radial bearing loads, use of brittle vane, cam, and port plate material, high carryover volume at low flow, and use of complex mechanisms to synchronize movable multiple cam rings.

Accordingly, there is a need for a balanced, variable displacement pump that is more robust and contamination tolerant and does not cause undesirable amounts of fluid system heating. The present invention provides a new and improved variable displacement pump for overcoming the above-referenced drawbacks and other shortcomings.

BRIEF SUMMARY OF THE INVENTION

The present invention relates to a variable displacement pump. More particularly, the present invention relates to a dual lobe, split ring, variable displacement roller vane pump for supplying, for example, an aircraft engine varying amounts of fuel.

In accordance with the present invention, an improved variable displacement roller vane pump is provided. The pump comprises a housing having an inlet and an outlet, a rotor having a plurality of slots rotatably mounted within the housing and a plurality of roller vanes operatively mounted within the slots. A pair of port plates are mounted on opposite axial sides of the rotor and two cam segments movably mounted around the rotor for selective radial movement relative to the rotor. Each cam segment has a curvilinear surface for cooperating with the rotor, the port plates, and the roller vanes to define a plurality of pumping chambers. The cam segments are independently movable to create varying volumetric pumping chambers along the curvilinear surface of the cam segments. The pump additionally comprises unique fluid communication passages for providing fluid into the pumping chambers from the pump inlet and for discharging the fluid from the pumping chambers to the pump outlet.

In accordance with one aspect of the present invention, a tongue and groove connection is provided between the cam segments for seamless transition of the roller vanes during rotation from one cam segment to the other.

In accordance with another aspect of the present invention, the port plates preferably include radially aligned inlet and cutlet channels for balanced fluid communication with the pumping chambers. The port plates also include radially aligned pressure inlet and outlet channels for balanced fluid communication with the slots beneath the roller vanes.

In accordance with another aspect of the present invention, the roller vanes are load supported in the slots by a shoe. Additionally, the shoe configuration prevents the roller and shoe from being improperly assembled in the rotor slot.

One advantage of the present invention is the provision of a variable displacement roller vane pump that reduces excess fluid flow to a system and the resulting energy loss and heating of the fluid being pumped.

Another advantage of the present invention is the provision of a rotor of a variable displacement vane pump that is normally "pressure balanced" to minimize the loads transmitted to the pump bearings.

Yet another advantage of the present invention is the provision of a variable displacement roller vane pump that may be used for a wide variety of applications.

Still another advantage of the present invention is the provision of a variable displacement vane pump that utilizes rollers as the vanes.

A still further advantage of the present invention is the provision of a variable displacement vane pump that is low in weight and total volume.

A still further advantage of the present invention is the provision of a variable displacement vane pump in which each cam segment can be independently controlled.

A still further advantage of the present invention is that the pump can be used with two independent discharges with a single inlet or two independent inlets with two independent discharges or any combination of the above.

Further advantages and benefits of the present invention will become apparent to those skilled in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating the presently preferred embodiments and are not to be construed as limiting the invention.

DETAILED DESCRIPTION OF THE INVENTION

Figure 1:
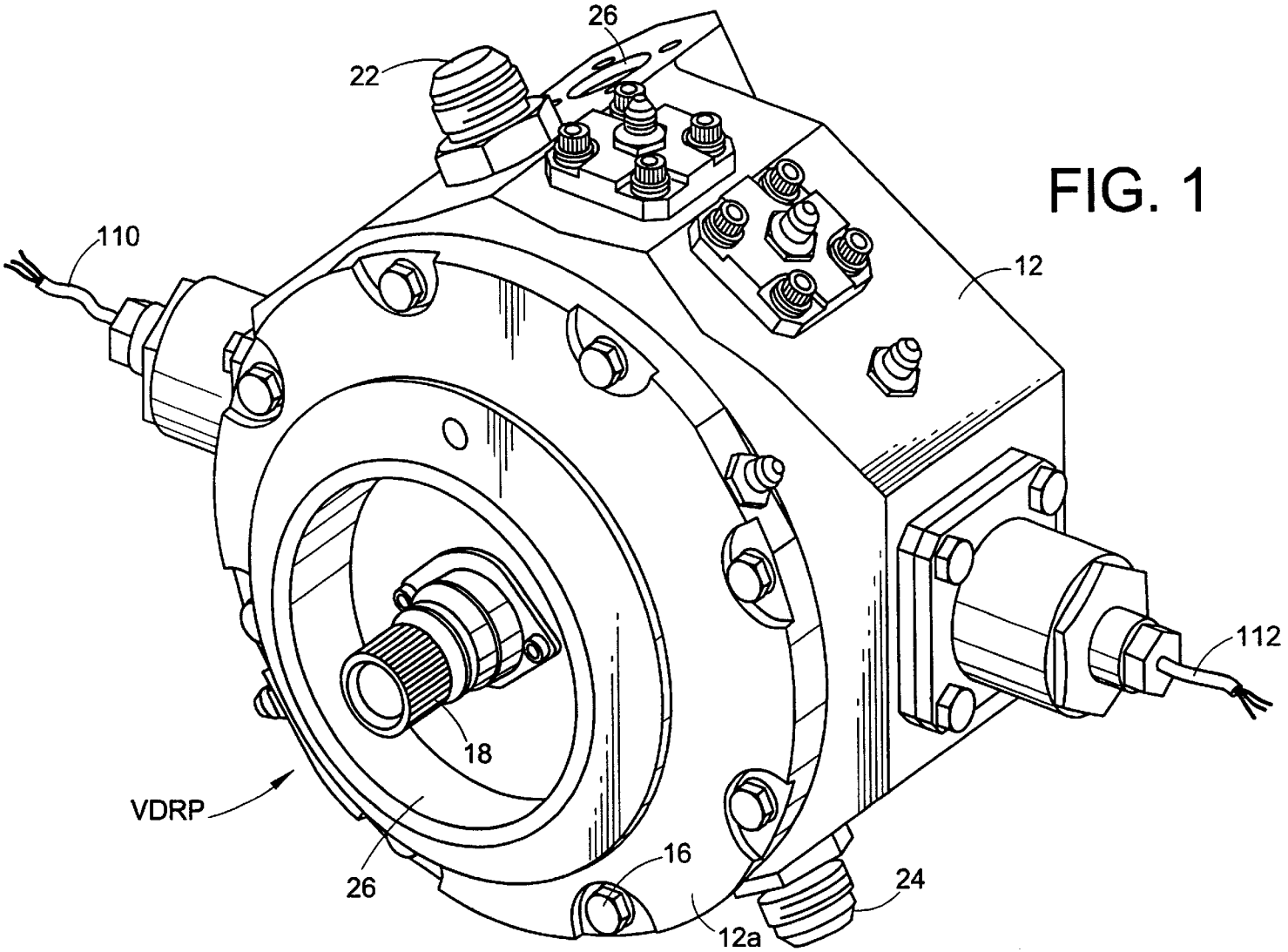
FIG. 1 is an isometric view of a variable displacement pump according to the present invention.
Figure 2:
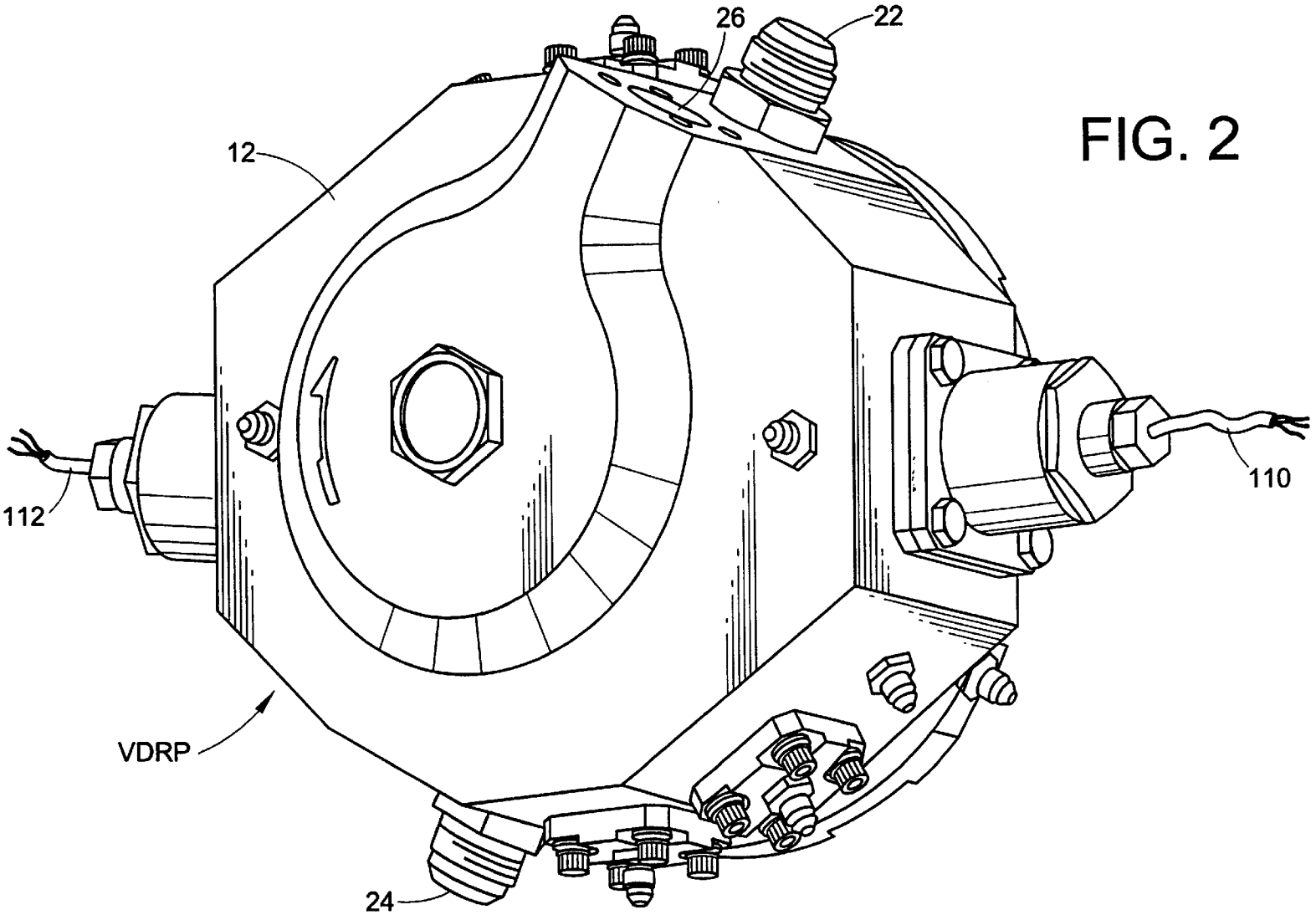
FIG. 2 is an isometric view of the variable displacement pump shown in FIG. 1 showing an opposite side of the pump.

With reference to FIGS. 1 and 2, a variable displacement roller vane pump is indicated generally by reference character VDRP. The pump comprises an external housing assembly 12 and a plate-shaped housing member or portion 12*a*. The housing members are connected and secured together in mating relation by a plurality of fasteners such as bolts 16. The housing includes an interface 18, 20 for operative reception within a drive transfer assembly such as a gear box (not shown) as is conventional and well known in the art.

According to a preferred embodiment, first and second inlet ports 22, 24 are disposed on the housing. The inlets 22, 24 are connected to a source of pressurized primary fluid (not shown), such as jet engine fuel. A discharge port 26 is also provided on the housing 12.

Figure 3:
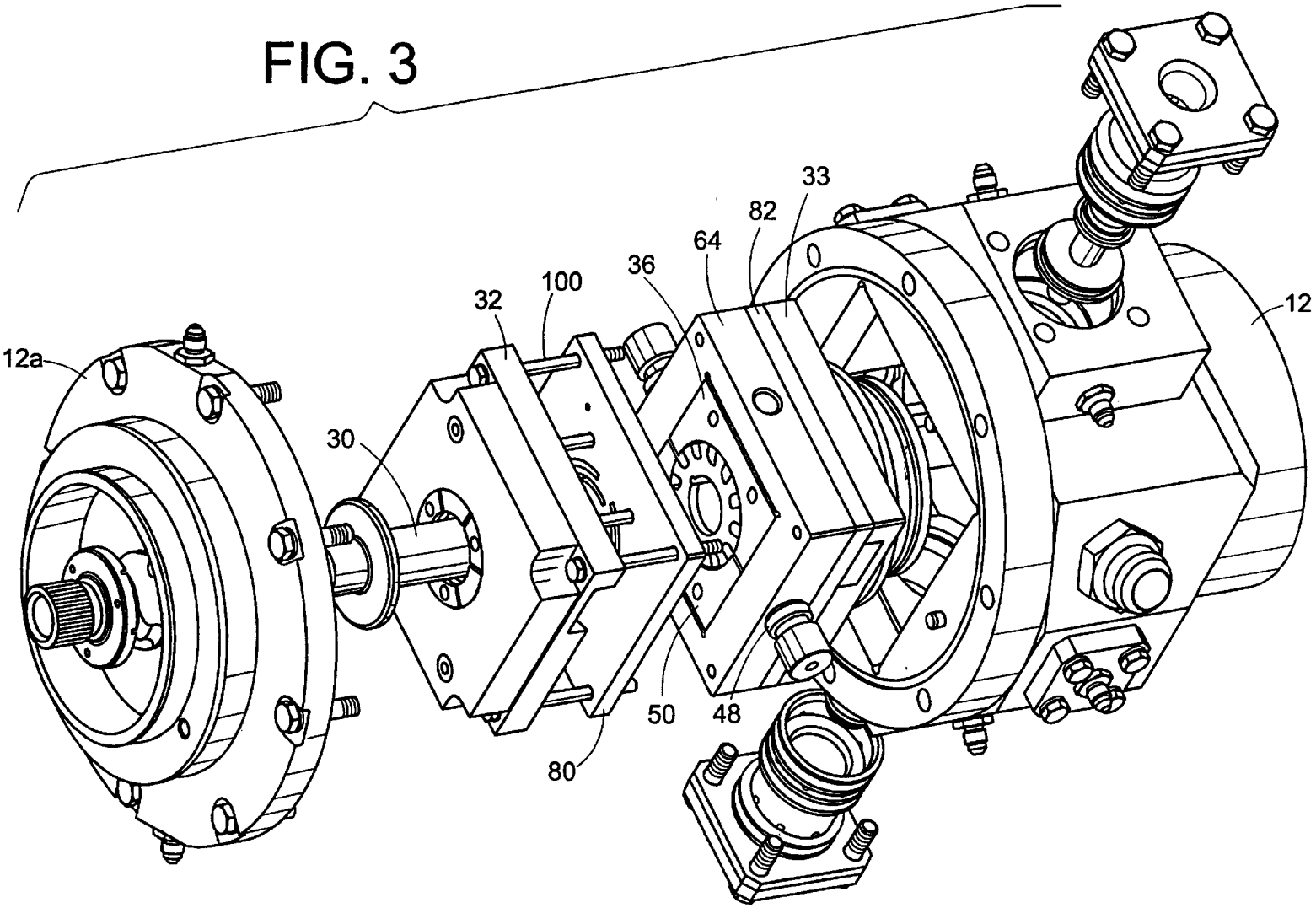
FIG. 3 is an exploded assembly view of a variable displacement pump according to the present invention.
Figure 4:
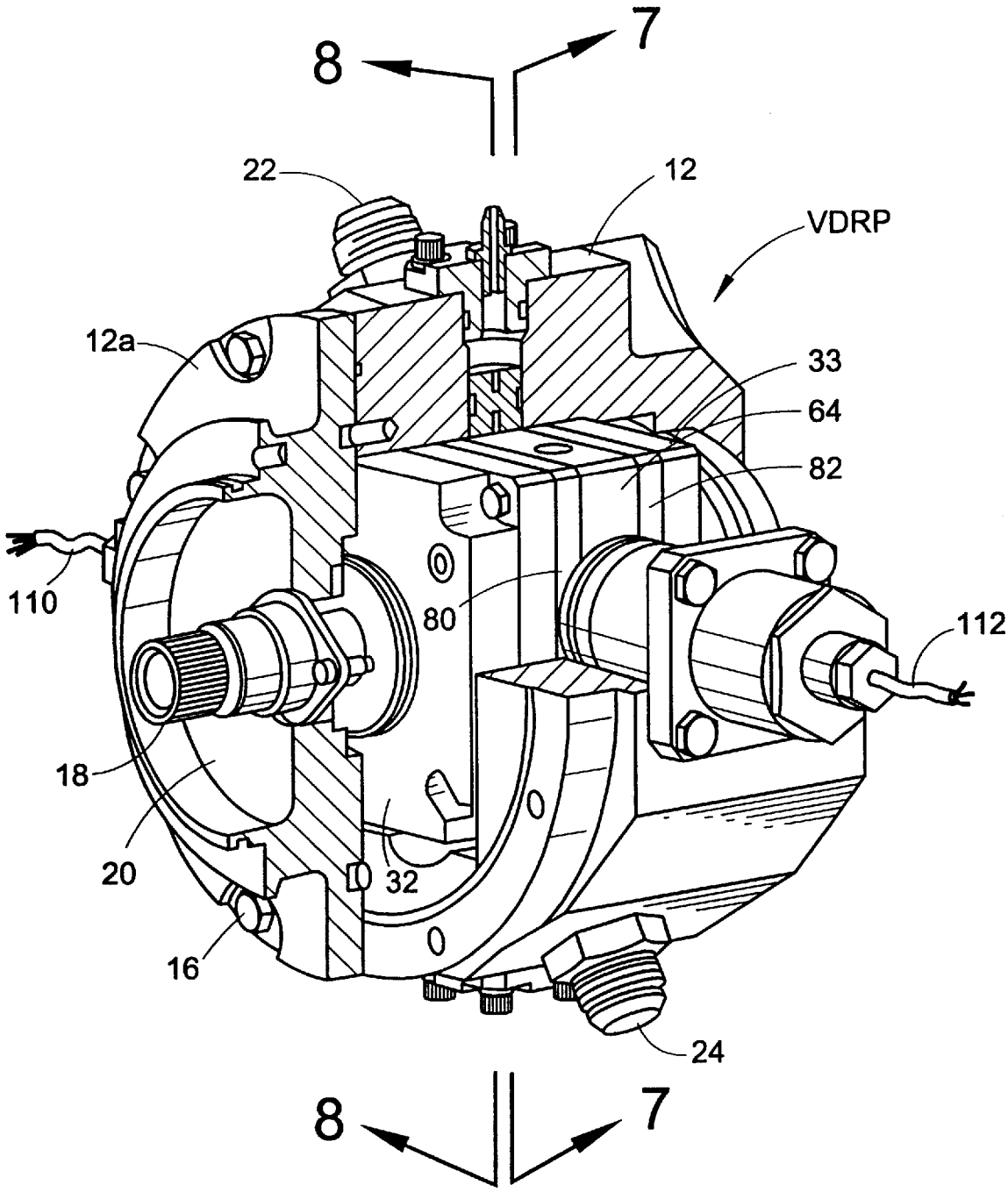
FIG. 4 is an isometric view of a variable displacement pump according to the present invention with selected portions cut away for ease of reference.

FIGS. 3 and 4 show a shaft 30 operatively received in the housing 12 and extending through an opening formed in the housing cover. The shaft 30 includes a spline or keyed arrangement for engaging pump shaft 35. Shaft 35 in turn includes a keyed or spline arrangement for engaging a mating conformation on rotor 36. The pump shaft and rotor are rotatably supported by a set of bearing assemblies which include bearing plates 32, 33 mounted within the housing.

The rotor 36 has a plurality of recesses or slots 38 which open outwardly toward the periphery of the rotor. In the illustrated embodiment, sidewalls of the slots 38 are disposed substantially parallel with and angled toward a rotational axis RA of the rotor. The slots 38 extend over the full axial length of the rotor from one port plate to the other port plate. The slot profile is asymmetrical as represented by portions 38*a*, 38*b* for reasons which will become more apparent below. In an exemplary embodiment, twelve slots 38 are defined in the rotor 36 and equispaced about the circumference. Of course, a different number of slots can be employed in other embodiments without departing from the scope and intent of the invention. Additionally, the conformation and orientation of the slots in the rotor may also vary in response to particular pumping parameters that may be desired.

Figure 5:
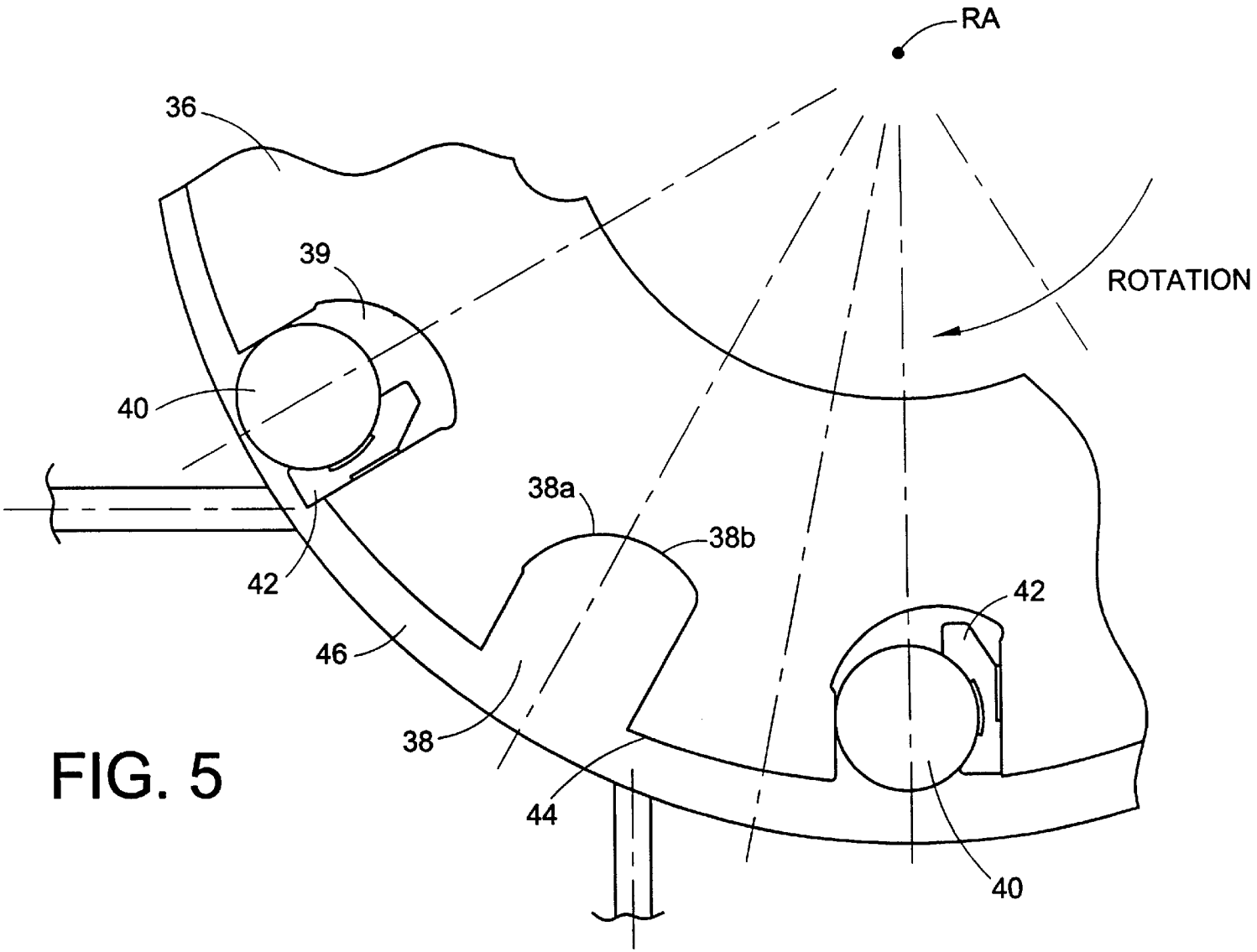
FIG. 5 is a partial diagrammatic view of a rotor and its plurality of rotor slots according to the present invention.
Figure 6:
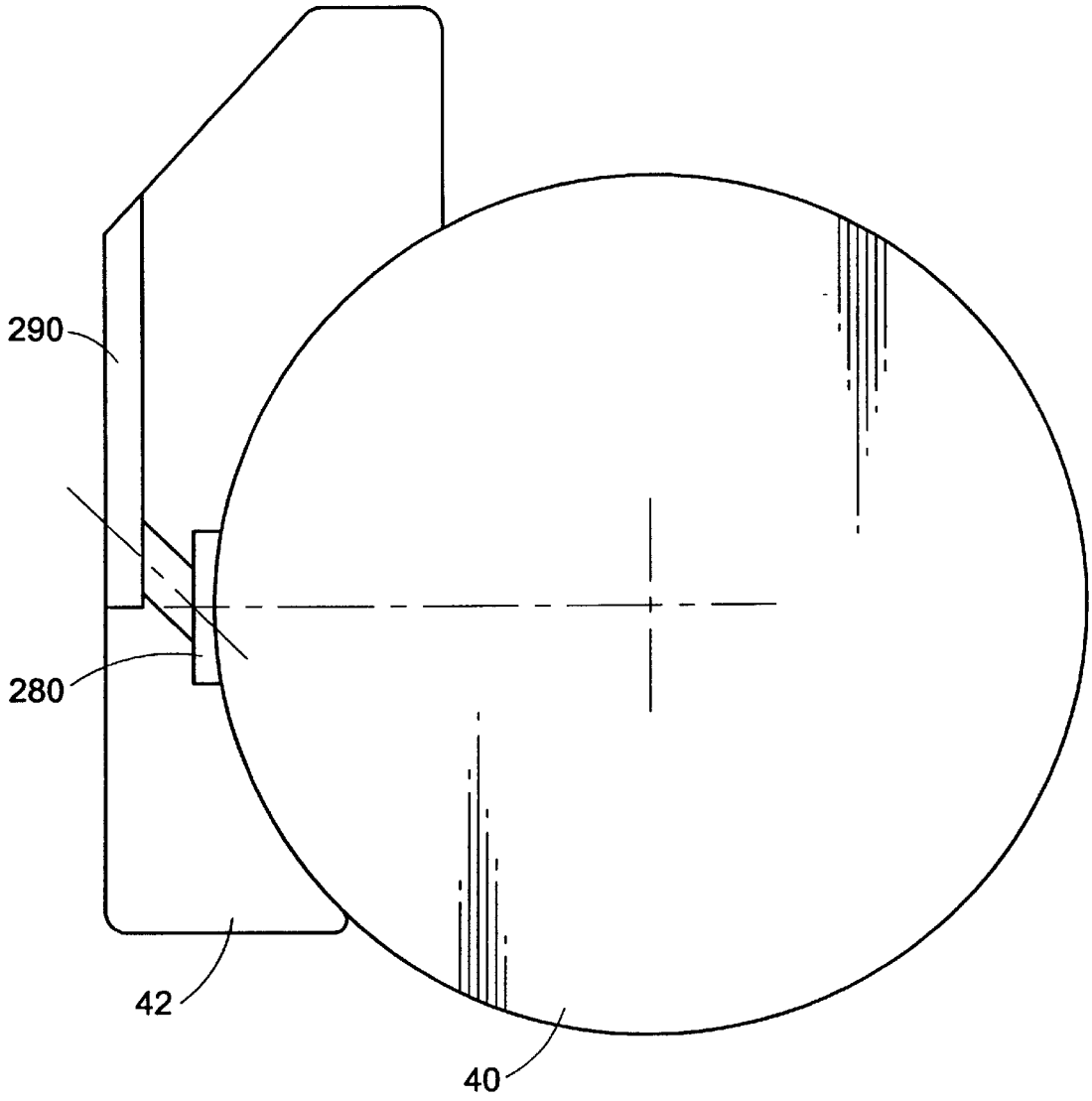
FIG. 6 is a diagrammatic view of a roller vane and shoe engagement according to the present invention.

FIGS. 5 and 6 more particularly illustrate a vane, or roller, 40 and accompanying shoe 42 fitted into each slot 38. The roller and shoe are dimensioned for radial movement in the slot. A peripheral portion 44 of the rotor in conjunction with the roller vanes confine the pumped fluid and define, in part, the walls of a plurality of pumping chambers 46 in the preferred embodiment. The roller vanes 40 and shoes 42 extend the entire axial length of the slots. It is to be appreciated that other types of vanes may be employed such as split opposed vanes, conventional vanes, and even an "intra" vane may be used should a specific design application so warrant.

The shoes 42 supporting the rollers in the rotor and are dimensioned for cooperation with the contour of the asymmetrical slots to ensure that the rollers are properly positioned in the rotor 36. The shoes 42 are preferably positioned on the driving side of the slots, i.e., the shoes push the vanes rollers during the rotation of the rotor. The shoes also serve the purpose of providing a supporting and conforming surface for a lubricating fluid film development to support portions of the vane load into the body of the rotor. It will be appreciated that the shoes could also be positioned on the opposite side of the roller vanes in an alternate embodiment to support any loads which may be imparted to the vanes during other uses of the pump.

Figure 7:
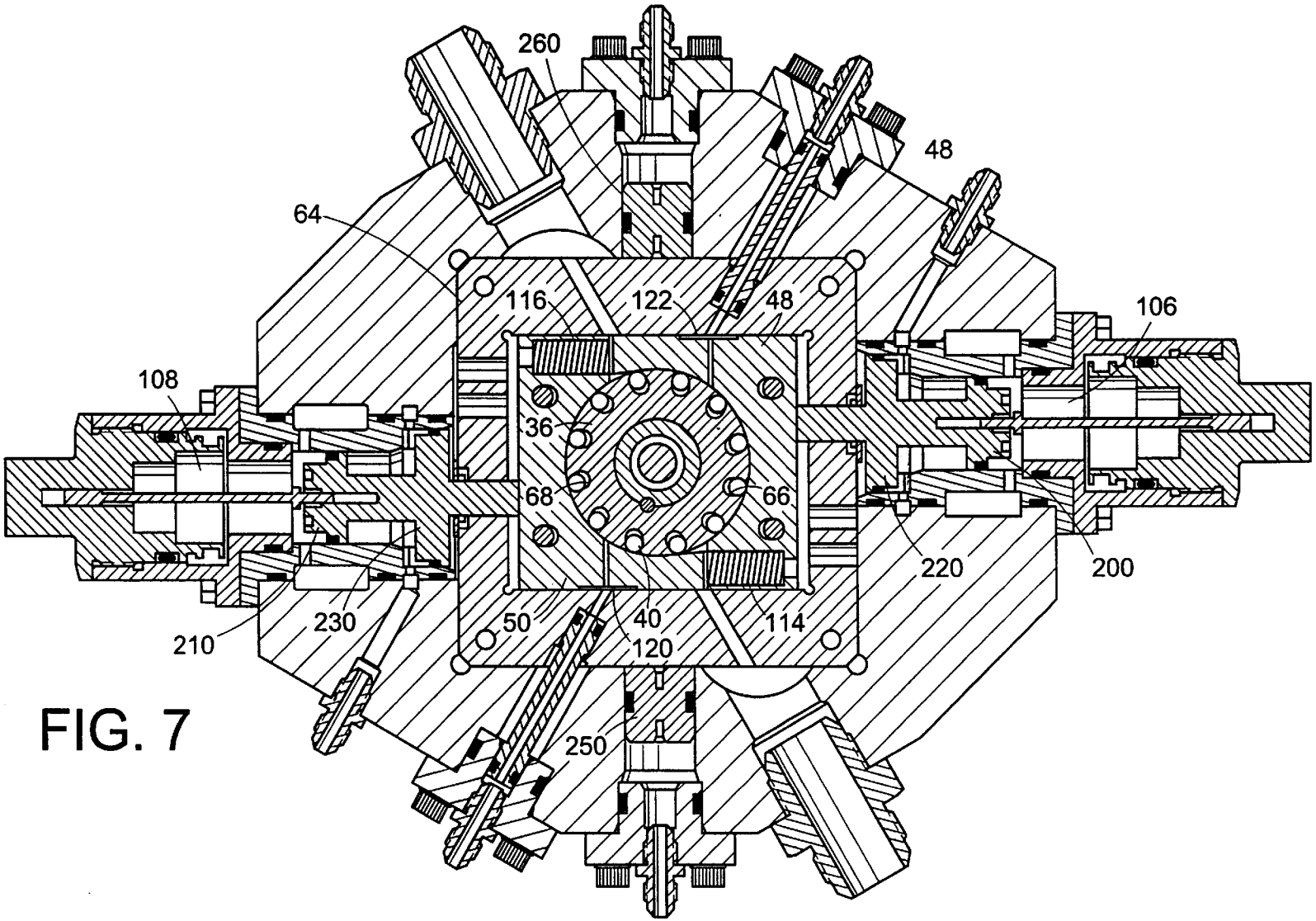
FIG. 7 is a cross-sectional view of a variable displacement pump taken generally along the line 7—7 of FIG. 4.
Figure 9:
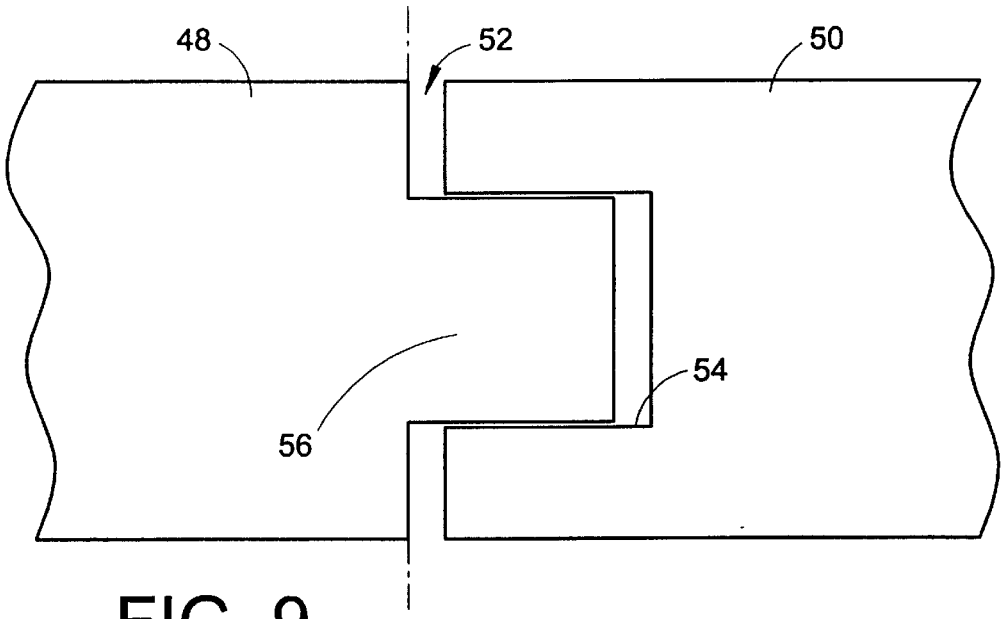
FIG. 9 is a diagrammatic view of a tongue and groove cam ring connective joint in accordance with the present invention.
Figure 10:
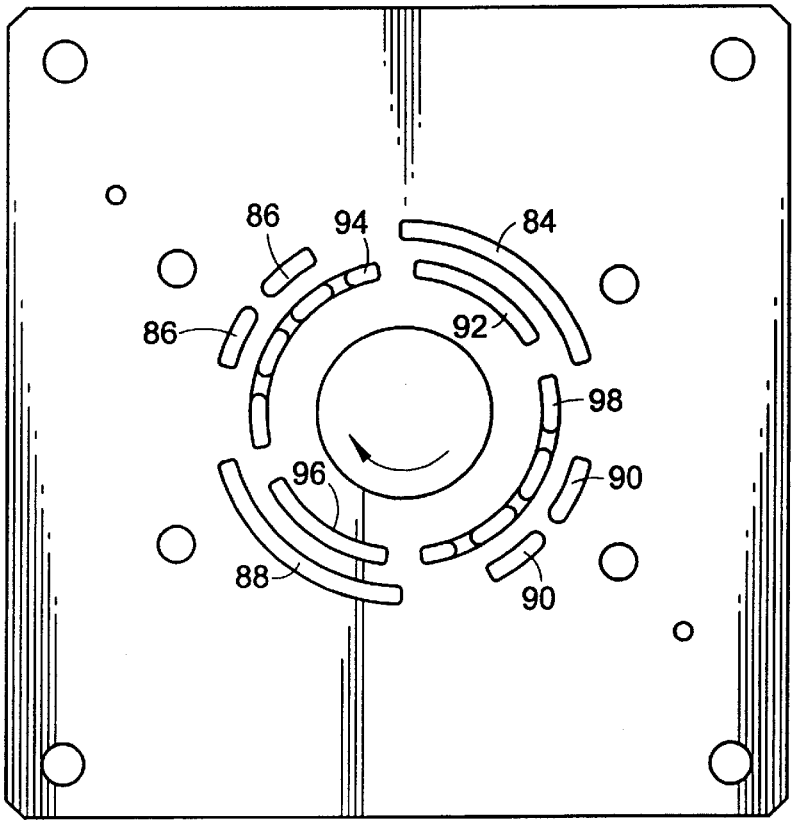
FIG. 10 is an elevational view of a port plate in accordance with the present invention.

FIGS. 3 and 7 clearly illustrate a pair of oppositely opposed lobes, semi-circle, split rings or cam segments 48, 50 encircling the rotor 36. The two cam segments 48, 50 are preferably identical for ease of manufacture and assembly. The cam segments overlap each other to form a seamless tongue and groove connection 52 (FIG. 9) defined by a groove 54 in one cam segment that receives a tongue 56 in the other cam segment.

The first and second cam segments 48, 50 are independently movable relative to the rotational axis or centerline of the rotor 36. The cam segments are secured within a cam block 64 that encompasses and radially retains the cam segments in position. The cam segments 48, 50 include a generally curve-shaped inner contour 66, 68, respectively. When the cam segments are at a zero displacement position, a circular three hundred sixty degree (360°) arc profile is provided for the vanes 40 to traverse. However, when one or both cam segments are moved radially outward, the cam segment(s) create a non-circular, eccentric curve akin to an oval or elliptical-shaped profile for the roller vanes to traverse. This action causes a change in the captured volume of the pumping chambers which carry fluid from the inlet to the pump discharge.

The cam segment inner contours 66, 68 are traversed by the radially movable roller vanes in the rotor 36. The rollers build a hydrodynamic layer between the rollers and the inner contours of the cam segments to preclude metal to metal contact and increase the useful life of the pump components. Thus, the inner contours 66, 68 of the cam segments define another portion of the walls of the pumping chambers 46. The distance between the cam segments 48, 50 and the rotor is variable depending, in part, on the position of the cam segments 48 and 50 relative to the centerline of the rotor. Likewise, the contact load of the roller vanes 40 engaging the cam segments can be varied as desired by deliberately offsetting the angle of slots 38 with respect to the rotor centerline. The resulting hydraulic load on the roller and cam surface can be modified.

Figure 8:
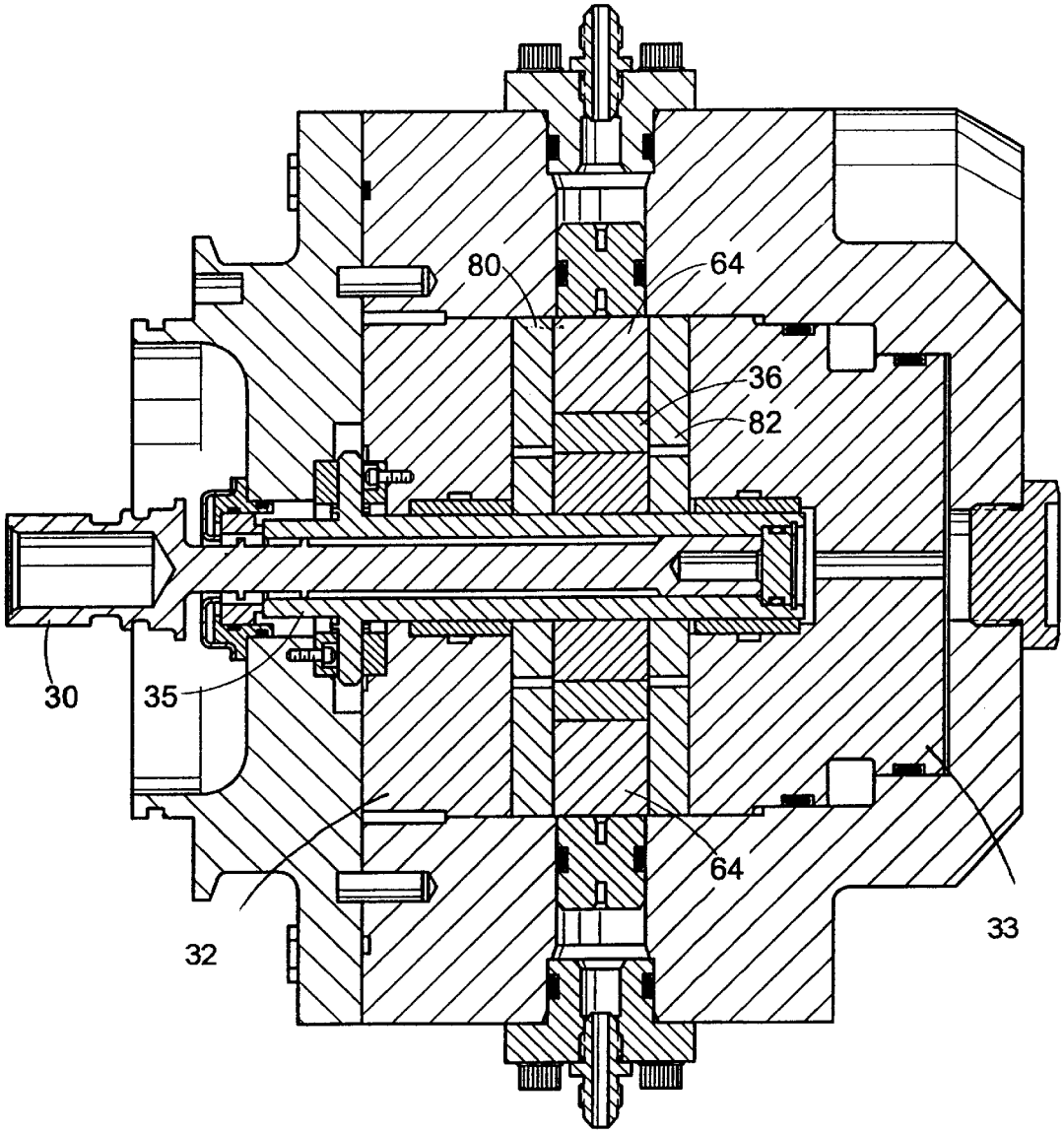
FIG. 8 is a cross-sectional view of a variable displacement pump taken generally along the line 8—8 of FIG. 4.

First and second port plates 80, 82 are operatively disposed on either side of the assembly of the rotor 36, cam segments 48, 50 and the cam block 64 (FIGS. 3, 4 and 8). The port plates 80, 82 prevent axial movement of the cam segments and define immobile walls of the pumping chambers 46 in an axial direction. Thus, the variable volume of the pumping chambers is dependent on the distance between the rotor and the cam segments which is spanned by the adjacent radially movable roller vanes.

The port plates 80, 82 each include respective shaft openings for receiving the shaft 35. In addition, each port plate includes a first port inlet channel 84 and a first port outlet channel 86 for selective fluid communication with the pumping chambers 46 when circumferentially located adjacent the first cam segment. Each port plate also includes a second port inlet channel 88 and a second port outlet channel 90 for fluid communication with the pumping chambers 45 when disposed adjacent the second cam section 50. The inlets 84, 88 and outlets 86, 90 are concentric relative to the axis of the rotor. The configuration of the port channels 84–90 prevents any one pumping chamber 46 from communicating with more than one channel at any given rotational position of the rotor 36.

Each port plate 80, 82 additionally includes a first pressure inlet channel 92 and a first pressure outlet channel 94 for fluid communication with the area defined by the slots 38 beneath the roller vanes when located adjacent the first cam section 48. Likewise, each port plate also includes a second pressure inlet channel 96 and a second pressure outlet channel 98 for fluid communication with the area defined by the slots beneath the roller vanes when disposed adjacent the second cam section 50. The inlets 92, 96 and outlets 94, 98 are all concentric relative to the axis of the rotor. The pressure channels 92–98 allow either inlet or discharge fluid to be present under the vanes, dependent on the pressure between successive vanes which form the pumping chambers 46. Thus, the pressure channels effectively communicate the pressure level on the side of the vane adjacent the rotor in response to the pressure on the side of the vane adjacent the cam segments 48, 50 as the roller vane traverse the cam segments 48, 50.

As will be appreciated from FIGS. 3 and 4, bearing plates 32, 33 are disposed adjacent to the port plates on the axial opposite side of the port plates from the cam block 64. A plurality of fasteners such as bolts 100 span between the bearing plates and sandwich the cam block 64 and port plates 80, 82 therebetween. Thus, the cam block is flanked on opposite sides by the port plates and the port plates are flanked by the bearing plates.

The bearing plates 32, 33 preferably include passages (not shown) in fluid communication with the first port inlet channels 84 and the first pump inlet 22 and, similarly, in fluid communication with the first port outlet channels 86, second port inlet channels 88, the pump outlet 26, and the second pump inlet 24. A fluid communication is included between pump outlet 26 and the bearings in bearing plates 32, 33. This provides lubricating bearing flow to rotatably support the pump shaft 35.

As discussed above, the cam segments 48, 50 are independently movable to create varying non-circular or elliptical cam profiles for the roller vanes to traverse. When the cam segments are maintained at zero displacement, the volume in the pumping chambers 39 and 46 is minimal and remains constant as the rotor 36 is rotated about axis RA allowing only minimal carryover volume. When the cam segments 48, 50 are moved radially outward from their respective zero displacement positions, the circular cam profile is offset with respect to the centerline of rotation of the rotor. This creates a volumetric expanding and contracting area on each cam section for the pumping chambers. As a result, fluid inlets into the expanding area and discharges into the contracted area of one of the cam segments thus moving a fixed volume of fluid from inlet to outlet for each revolution of the rotor.

The twelve distinct pumping chambers cycle through the expanding and contracting volumes on each cam segment. The selection of twelve pumping chambers, or some other odd or even number of chambers, enables the transition of the pumping chambers 39, 46 between port inlet channels 84, 88 and port outlet channels 86, 90 to be balanced during rotation of the rotor. More specifically, a pumping chamber 46 separates the first port inlet channels 84 from the first port outlet channels 86. Likewise, a pumping chamber separates the second port inlet channels 88 from the second port outlet channels 90. Further, a pumping chamber separates first port outlet channels 86 from the second port inlet 88, and separates the second port outlet 90 from the first port inlet 84. A pumping chamber 39 separates the first port inlet channels 92 from the first port outlet channels 94. Likewise, a pumping chamber separates the second port inlet channels 96 from the second port outlet channels 98. Further, a pumping chamber 39 separates first port outlet channels 94 from the second port inlet 96, and separates the second port outlet 98 from the first port inlet 92. Separating the transition areas occurs simultaneously and minimizes the amount of trapped fluid and thus minimizes any pressure ripple in the delivered fluid.

In operation, the rotor is driven via the pump shaft 35 to create a centrifugal force and cause the roller vanes to move radially outward toward the cam segments. The roller vanes engage the contoured walls 66, 68 of the cam segments to create seals between adjacent pumping chambers. The volume of the pumping chambers is dependent upon the displacement of the cam segments from the centerline of the rotor.

Each cam segment position is controlled by an actuator piston 200 and 210. Control system pressure is acted upon the area of the actuator piston supplying the necessary force to move either cam segment in the desired displacement direction. Balance pistons 220, 230 are included as a means to counteract the force generated against the cam surface from the fluid pressure. The combination of discharge pressure acting on the balance piston and the control pressure acting on the actuator piston provide the necessary force balance to cause the cam segments to be placed in the desired position.

Cam position feedback, such as a pair of linear variable differential transducers (LVDT) 106, 108, are used to selectively monitor the radial displacement of the respective cam segments 48, 50 relative to the desired displacement. The pump control monitors the LVDTs and adjusts the actuator piston pressure to move the cam segments in the proper direction to provide the desired flow from the pump. The electrical leads 110, 112 provide power and signal interface to the LVDTs.

The cam segments include biasing means such as springs 114, 116 to urge the cam segments outward to maximum stroke relative to the centerline of the rotor. The actuator piston 200, 210 and balance pistons 220, 230 opposingly maintain a force on the cam segments against the bias of the springs and fluid pressure. As described above, the greater the displacement of one of the cam segments from the centerline of the rotor 36, the larger the pumping chambers 39, 46 are when disposed adjacent that cam segment. Likewise, the larger the pumping chambers, the greater the fluid flow discharged from the pump.

Variable flow control is achieved by selectively changing the pump displacement, i.e., moving one or both cam segments toward or away from the rotor operating centerline. Such movement of the cam segments can be done while the rotor/pump is in operation. Each cam section can be moved independently, if desired, and the pump used to provide pressurized fluid to two independent, wholly separate fluid circuits at different operating parameters (flow and pressure) or to different portions of the fluid circuit. It will be understood that if the two cam segments are not uniformly displaced, and the pump is operating two circuits at different pressure levels, then the rotor becomes pressure unbalanced creating bearing loads that can be accounted for.

An advantageous feature of the present invention is that the pump is pressure balanced during operation when used in a single discharge system or equal pressure in a dual discharge system. The dual lobe, cam segments each have inlet areas which are preferably diametrically opposite one another or 180 degrees apart. Likewise, the discharge areas are preferably located diametrically opposite one another or 180 degrees apart for these same reasons. Such an arrangement tends to balance the radial pressure loads imposed on the rotor. The pump overcomes the limitations of single lobe designs by balancing the loads imparted to the pump bearings. Further, when the inlet and discharge areas are at different pressure levels, fluid passages in communication between the outlet and the associated bearings can aid the bearings in supporting the rotor loads.

The separating load from the two cam segments is also preferably counterbalanced. One segment of the load vector is resolved to the planar sides of the cam segments into the cam block where the respective cam segments slide during displacement changes. Second, hydrostatic pads 120, 122 are used between the mating surfaces to offset the load (FIG. 7). The load in the direction ninety degrees to the flat side is reacted by allowing discharge pressure to be ported to the outside sealed cavity of the balance pistons 220, 230. An actuation piston is used to move the segment along its respective flat side. The actuation force required is low due to the pressure balancing employed in the design.

An advantageous feature of the design is that the cam loads imposed into the cam block from the respective flat sides are counterbalanced by pistons 250, 260 (FIG. 7) to prevent excessive deflection of the cam block.

A further advantage of the design is that the roller shoe contains hydrostatic pads 280, 290 designed to balance the imposed roller loads and augment development of hydrodynamic fluid films.

The pump is capable of providing the full benefits of variable displacement to the turbine engine fuel system. It is capable of metering fuel to the engine, as well as handling dedicated engine actuation needs. Separating the two cam segments into two flow circuits enables one circuit to be used, for example, for engine metered flow and the other circuit to be used for engine actuation flow on demand. Moreover, this is achieved while accommodating differing bearing loads from potentially different pressure requirements. The invention allows the clearance between the rotor and the port plates to be controlled in manufacture to improve the volumetric efficiency of the design for the pressure level to be required of the design. The pump can be thermally matched to maintain critical clearances regardless of fluid or ambient temperatures by proper material selection and design.

In summary, the design is a variable displacement, balanced dual lobe roller pump (VDRP) which operates with two single lobe, semi circular cam segments opposing each other. A control system is used to move the respective cam segments to achieve varying displacement as required for variable output flow. This is accomplished by the use of two opposed single ring cam segments to form a balanced dual lobe design with provisions to enable a single rotor and set of rollers to operate independently on the two opposed cam segments.

The design, at the minimum displacement position of the two cam segments, provides a normal 360 degree circular arc for the rollers to traverse. The two cam segments are Identical and overlap each other in the inlet zone by a "tongue and groove" design scheme. When the two segments are moved from the closed position, the circular cam profile is offset with respect to the centerline of rotation of the rotor with its respective rollers. This creates an expanding and contracting section in the two ninety degree segments of the cam. This enables fluid to be taken into the expanding area and discharged in the contracting section. This is repeated with the other section of the cam also.

The "tongue and groove" design feature between the two cam ring segments enables the rollers to transition from one cam ring to the other. The cam ring segments are contained between two port plates, one on each side of the two cam rings. The port plates communicate with the inlet and discharge circuits within the pump for both over vane and under vane communication.

The separating load from the two cam segments is counterbalanced by two other design features. One component of the pressure load vector is resolved to the flat sides of the cam ring into the surrounding body of the pumping mechanism where the respective cam segments slide during displacement changes. A hydrostatic pad with pump discharge pressure is used between the mating surfaces to balance the cam load in this direction. The load in the direction ninety degrees to the flat side is hydraulically balanced by porting pump discharge pressure into the cavity enclosed by the sealed balance piston and the actuation piston. The actuation piston load requirement is limited to that needed to overcome the sum of the inertia and friction loads associated with moving the cam segment along its respective flat side plus the cam separating spring loads. These springs provide the load necessary for increasing displacement by separation of the cam segments during normal operation and after stopping the engine for subsequent restart to full flow position.

The rollers are supported in their respective slots with a roller shoe which includes pressure pads intended to provide additional bearing support for the roller during operation. Pressure is also ported beneath the rollers, at appropriate port plate timing points, to enable either inlet or discharge fluid to be present under the rollers dependent on the rotation arc and pumping chamber pressures between rollers to ensure the rollers are always pressure balanced or loaded outward against the cam ring.

The design employs twelve rollers to enable the switching of active pockets to be identical for all pumping chambers around the entire section of both cam segments. This can be further stated as having one pumping chamber on each minor dwell (cam change zone between inlet and discharge pressures and to seal between), one on each of the major dwell zones (transition from inlet to discharge of the pumping sequence), two on each of the respective inlet ramps where fluid is being taken into the pumping chambers, and two on each of the respective discharge ramps where the fluid is expelled from the respective pumping chambers. The use of twelve pumping chambers, spaced as discussed in the four described sections, which change at the same time, minimizes any fluid trapping or transition which may affect the pressure ripple seen in the delivered fluid.

The rotor is driven by a single round drive key through the main shaft which is driven by the gearbox. This provides optimum alignment for the rotating parts, by giving the rotor the ability to center between the port plates.

The cam segments, rollers, roller shoes, and rotor are all sized by selection and or lapping to a fitted clearance less than the cam block, which allows the cam segments to translate. Control of the side clearance is critical to pump performance. The port plates provide flow into and out of the pumping group and sealing of the passages from the rotor slots to the through bore to the bearing cavities. The two pressure plates house the bearings and provide communication of the port plate ports from inside the pumping zones to the main housing passages and provide axial pressure balancing of the pump separating loads. The entire assembly is bolted together for ease of assembly and removal from the main housing.

The invention has been described with reference to the preferred embodiments. Obviously, modifications and alterations will occur to others upon reading and understanding the preceding detailed description. For example, the invention has been described in association with a gas turbine fuel system and could alternately be used in an engine geometry fuel actuation system or in a hydraulic system for airframe and industrial applications. It is intended that the invention be construed as including all such modifications and alterations insofar as they come within the scope of the appended claims or the equivalents thereof.

Having thus described the preferred embodiment, the invention is now claimed to be:

1. A variable displacement vane pump, comprising:

a housing:

a rotor received within the housing for rotation about a center of rotation, the rotor having a plurality of slots that each receive a support shoe;

a plurality of vanes operatively mounted within the slots of the rotor with each vane engaging a support shoe first and second cam segments each operatively mounted within the housing and independently movable relative to the rotor to create varying volumetric pumping chambers;

an inlet provided in the housing for introducing fluid into the plurality of pumping chambers;

an outlet provided in the housing for discharging fluid from the plurality of pumping chambers; and a hydrostatic pad in each shoe that supports a vane hydraulic pressure load.

2. The pump of claim 1, wherein the cam segments are joined together by a tongue and groove connection for seamless transition of the vanes from one cam section to the other cam section.

3. The pump of claim 1, wherein each of the plurality of vanes is received within one of the plurality of slots and is accompanied by the support shoe on a drive side of the slot, the shoe being configured to prevent the vane and shoe from being placed in the rotor slot incorrectly.

4. The pump of claim 1, wherein the plurality of vanes are roller vanes that are radially movable within the slots.

5. The pump of claim 1, further comprising first and second actuators for moving the first and second cam segments, respectively.

6. The pump of claim 1, wherein the slots are angled relative to the center of rotation of the rotor to minimize contact load of the vanes to the cam segments.

7. The pump of claim 1, wherein the cam segments are oppositely disposed in the housing for balance purposes.

8. The pump of claim 1, wherein the rotor is radially surrounded by the cam segments and axially received between first and second port plates, which are axially received between first and second bearing assemblies.

9. The pump of claim 1, wherein cam forces are balanced by balance pistons in unison with actuator pistons.

10. The pump of claim 1, wherein cam segment forces are balanced by balance pistons to prevent deflection.

11. The pump of claim 1, wherein the vanes are rollers supported by said shoes and further comprising hydrostatic pads in the roller shoes to balance fluid pressure forces imposed by the rollers.

12. The pump of claim 1, wherein the rotor and cam segments are thermally matched to prevent changing of operating clearances with fluid and ambient temperature changes.

13. The pump of claim 1, further comprising first and second port plates axially positioned on opposite sides of the rotor.

14. The pump of claim 13, wherein the first and second port plates define at least one port inlet channel for directing fluid into the plurality of pumping chambers and at least one port outlet channel for directing fluid out of the plurality of pumping chambers.

15. The pump of claim 13, wherein the first and second port plates include a plurality of inlet and outlet channels generally equally spaced adjacent the rotor.

16. The pump of claim 13, wherein the first and second port plates define at least one pressure inlet channel for directing fluid into the plurality of slots receiving the vanes and at least one pressure outlet channel for directing fluid out of the plurality of slots receiving the vanes.

17. The pump of claim 1, further comprising a biasing member for urging the cam segments away from one another.

18. The pump of claim 17, an actuator for maintaining the cam segments at a desired position against the biasing member.

19. The pump of claim 18, a feedback means such as an LVDT for closing loop with the controller to maintain the cam segments at a desired position.

* * * * *